US010954931B2

(12) United States Patent
Paul et al.

(10) Patent No.: US 10,954,931 B2
(45) Date of Patent: Mar. 23, 2021

(54) LINEAR DISPLACEMENT PUMP WITH POSITION SENSING AND RELATED SYSTEMS AND METHODS

(71) Applicant: DH Technologies Development Pte. Ltd., Singapore (SG)

(72) Inventors: Phillip H. Paul, San Francisco, CA (US); Kenneth R. Hencken, Pleasanton, CA (US)

(73) Assignee: DH TECHNOLOGIES DEVELOPMENT PTE. LTD., Singapore (SG)

( * ) Notice: Subject to any disclaimer, the term of this patent is extended or adjusted under 35 U.S.C. 154(b) by 466 days.

(21) Appl. No.: 14/568,108

(22) Filed: Dec. 12, 2014

(65) Prior Publication Data

US 2016/0169223 A1 Jun. 16, 2016

(51) Int. Cl.

| | |
|---|---|
| ***F04B 51/00*** | (2006.01) |
| ***F04B 25/00*** | (2006.01) |
| ***F04B 19/00*** | (2006.01) |
| ***F04B 9/125*** | (2006.01) |
| ***F04B 9/12*** | (2006.01) |
| *F04B 9/08* | (2006.01) |

(52) U.S. Cl.

CPC ..... *F04B 19/006* (2013.01); *F04B 9/12* (2013.01); *F04B 9/125* (2013.01); *F04B 9/08* (2013.01)

(58) Field of Classification Search

CPC ..... F04B 25/005; F04B 27/02; F04B 37/02; F04B 49/12; F04B 2201/0206; F04B 2201/0207; F04B 19/006; F04B 1/02; F04B 9/109; F04B 9/111; F04B 9/113; F04B 9/08; F04B 9/12; F04B 9/125

USPC ..... 417/46

See application file for complete search history.

(56) References Cited

U.S. PATENT DOCUMENTS

| | | | | | |
|---|---|---|---|---|---|
| 4,537,058 | A | | 8/1985 | Luper et al. | |
| 4,594,057 | A | | 6/1986 | Morgan | |
| 4,878,284 | A | * | 11/1989 | Sawdon | B21D 39/031 29/243.53 |
| 5,056,036 | A | * | 10/1991 | Van Bork | F04B 49/065 417/14 |
| 5,167,311 | A | * | 12/1992 | Satoh | F16H 61/12 192/3.58 |
| 5,170,691 | A | * | 12/1992 | Baatrup | F04B 9/107 417/403 |
| 5,513,962 | A | * | 5/1996 | Easton | F04B 9/125 417/401 |
| 6,017,200 | A | * | 1/2000 | Childs | B01D 61/06 417/404 |
| 6,168,387 | B1 | * | 1/2001 | Able | F04B 15/02 324/207.16 |
| 6,231,310 | B1 | * | 5/2001 | Tojo | F04B 35/045 417/417 |

(Continued)

FOREIGN PATENT DOCUMENTS

| | | |
|---|---|---|
| WO | 1991/006062 | 5/1991 |

*Primary Examiner* — Connor J Tremarche

(74) *Attorney, Agent, or Firm* — Ronald A. Rudder

(57) ABSTRACT

In a linear displacement pump, liquid is discharged by driving a piston along at least part of a stroke length. While discharging the liquid, a linear position of the piston is sensed at a plurality of positions along the stroke length, and a plurality of output signals is produced. Based on one or more of the output signals, an operational state of the pump is determined.

13 Claims, 3 Drawing Sheets

(56) References Cited

U.S. PATENT DOCUMENTS

| | | | | |
|---|---|---|---|---|
| 6,752,171 | B1 * | 6/2004 | Kemmler | F15B 20/002 137/552 |
| 6,948,549 | B2 * | 9/2005 | Wust | B22D 17/14 164/113 |
| 7,270,119 | B2 * | 9/2007 | Mitsutani | F02D 41/1482 123/674 |
| 8,550,794 | B2 * | 10/2013 | Du | F04B 3/00 417/418 |
| 2005/0042111 | A1 | 2/2005 | Zaiser et al. | |
| 2007/0191770 | A1 * | 8/2007 | Moberg | A61M 5/1452 604/131 |
| 2010/0198182 | A1 * | 8/2010 | Lanigan | A61J 1/20 604/406 |
| 2011/0002802 | A1 * | 1/2011 | Capone | F04B 7/00 417/486 |
| 2011/0008189 | A1 * | 1/2011 | Nguyen | F04B 9/127 417/399 |
| 2011/0132687 | A1 * | 6/2011 | Ifield | F16N 11/10 184/6.23 |
| 2013/0020519 | A1 * | 1/2013 | Lymberopoulos | F16K 31/1225 251/213 |
| 2013/0039778 | A1 * | 2/2013 | Blackson | F04B 17/04 417/44.1 |
| 2013/0269800 | A1 * | 10/2013 | Fromont | G01M 13/00 137/565.16 |
| 2013/0336814 | A1 * | 12/2013 | Kamen | A61M 5/16859 417/282 |

* cited by examiner

LINEAR DISPLACEMENT PUMP WITH POSITION SENSING AND RELATED SYSTEMS AND METHODS

TECHNICAL FIELD

The present invention generally relates to linear displacement pumps, including pumps configured for use in low-flow rate and microfluidic applications. In particular, the invention relates to sensing or monitoring a linear position of a piston of the pump.

BACKGROUND

A pneumatically-driven, high-pressure liquid pump may employ a large-diameter gas-driven piston directly linked to a smaller-diameter piston that acts to positively displace liquid. Such a pump is often equipped with an end-of-stroke sensor that determines when the pump should be reset for the next pumping cycle (i.e., at or near the end-of-stroke position of the pistons). This is particularly true in "one stroke per run" applications entailing low flow rates and pulsation-free delivery of liquid, one specific example being low-flow high performance liquid chromatography (HPLC). Typically, end-of-stroke sensing has been implemented by a piston coming into contact with a mechanical relay or optical interrupt as the piston reaches the end-of-stroke. The sensor may then transmit a signal to a pump controller to initiate a re-stroke. Apart from determining end-of-stroke, the sensor is not useful for acquiring any other type of information, and typically no other sensors are employed in the pump to monitor piston movement and operation. Moreover the pump, particularly in high-pressure applications, is prone to fluid leakage through seals, check valves, and fluid connections downstream from the pump. In one stroke per run applications, the duration of the run time of the pump during the discharge stroke may be long enough that fluid leakage constitutes a significant impairment to pump performance or to the application in which the pump is implemented. Also, in low flow rate applications the leakage rate may be large relative to the flow rate. Likewise, fluid leakage may be a significant detriment in applications requiring highly precise flow rates.

Therefore, there is a need for a pump capable of sensing or monitoring piston movement and operation. There is also need for a pump capable of providing information useful in determining leakage and other diagnostic information.

SUMMARY

To address the foregoing problems, in whole or in part, and/or other problems that may have been observed by persons skilled in the art, the present disclosure provides methods, processes, systems, apparatus, instruments, and/or devices, as described by way of example in embodiments set forth below.

According to one implementation, a method for pumping a liquid in a linear displacement pump includes discharging liquid from the pump by driving a piston of the pump in contact with the liquid along at least part of a stroke length, wherein the stroke length is a distance from a bottom-of-stroke position to a top-of-stroke position of the piston; while discharging the liquid, sensing a linear position of the piston at a plurality of positions along the stroke length; producing a plurality of output signals respectively corresponding to the plurality of positions sensed; and based on one or more of the output signals produced, determining an operational state of the pump.

According to another implementation, a linear displacement pump includes a housing comprising a first chamber, a first port communicating with the first chamber, a second chamber fluidly isolated from the first chamber, a second port communicating with the second chamber, and a third port communicating with the second chamber, wherein the housing defines a liquid flow path from the second port, through the second chamber and to the third port; a first piston linearly movable through the first chamber along a stroke length from a bottom-of-stroke position to a top-of-stroke position; a second piston linearly movable through the second chamber, and mechanically communicating with the first piston wherein the second piston is movable with the first piston; and a linear position sensor communicating with the first piston and configured for sensing a position of the first piston at any position thereof along the stroke length.

According to another implementation, the linear displacement pump includes a stationary seal fluidly isolating the second chamber from the first chamber, wherein the second piston is linearly movable through a bore of the stationary seal.

According to another implementation, the first port communicates with a pressurized gas source, and the linear displacement pump further includes a biasing element coupling the first piston and the housing and configured for imparting a biasing force to the first piston while the first piston is driven by pressurized gas toward the top-of-stroke position.

According to another implementation, a fluid handling system includes a pressurized gas source; a liquid source; a liquid displacement pump, wherein the first port communicates with the pressurized gas source and the second port communicates with the liquid source; and a controller configured for controlling a flow of pressurized gas from the pressurized gas source to the first chamber.

According to another implementation, the fluid handling system includes a flow meter communicating with the third port and configured for measuring a first volumetric flow rate of liquid discharged from the third port, wherein the controller is configured for receiving one or more output signals from the linear position sensor and, based on the one or more output signals received, determining a second volumetric flow rate of liquid from the second chamber into the third port and determining whether the first volumetric flow rate and the second volumetric flow rate differ.

According to another implementation, the controller is configured for comparing a difference between the first volumetric flow rate and the second volumetric flow rate to one or more stored values and, based on the comparison, adjusting the flow of pressurized gas to the first chamber, providing a user alert, and/or shutting down the linear displacement pump.

According to another implementation, the fluid handling system includes a detector communicating with the third port and configured for measuring a property of liquid pumped from the second chamber.

According to another implementation, the fluid handling system includes an analytical separation element communicating with the third port.

According to another implementation, the fluid handling system includes a chromatographic column communicating with the third port and a sample inlet for introducing a sample into a flow of liquid from the third port at, or upstream of, the chromatographic column.

According to another implementation, a fluid handling system includes a pressurized gas source; a first liquid source; a first liquid displacement pump, wherein the first port of the first liquid displacement pump communicates with the pressurized gas source and the second port of the first liquid displacement pump communicates with the first liquid source; a second liquid displacement pump, wherein the first port of the second liquid displacement pump communicates with the pressurized gas source and the second port of the second liquid displacement pump communicates with the second liquid source; and a controller configured for controlling respective flows of pressurized gas from the pressurized gas source to the first chamber of the first liquid displacement pump and to the first chamber of the second liquid displacement pump.

According to another implementation, the controller is configured for varying respective flow rates of a first liquid from the second chamber of the first liquid displacement pump and a second liquid from the second chamber of the second liquid displacement pump, by controlling the respective flows of pressurized gas according to a predetermined flow rate profile.

According to another implementation, the fluid handling system includes a mixer communicating with the respective third ports of the first liquid displacement pump and the second liquid displacement pump, and an analytical separation element communicating with the mixer, wherein the controller is configured for varying respective flow rates of a first solvent from the second chamber of the first liquid displacement pump and a second solvent from the second chamber of the second liquid displacement pump, by controlling the respective flows of pressurized gas according to a predetermined gradient elution profile.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
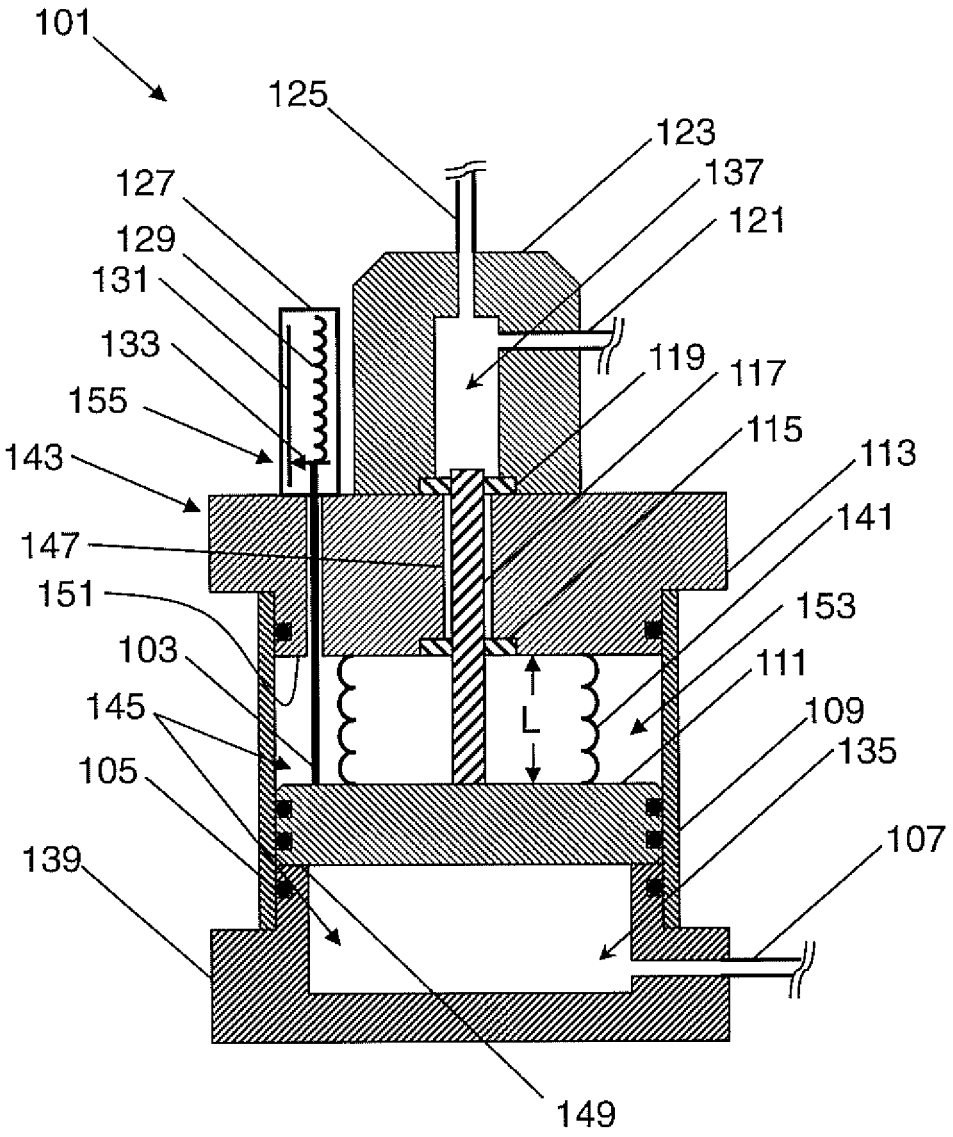
FIG. 1 is a cross-sectional view of an example of a linear displacement pump (or pump assembly) according to one implementation.

FIG. 1 is a cross-sectional view of an example of a linear displacement pump (or pump assembly) 101 according to one implementation. The pump 101 may be characterized as a type of positive displacement pump. The pump 101 may be configured for operation at high fluid pressures. In some implementations, the pump 101 operates at a pressure ranging from 100 psig to 15,000 psig. For high-pressure operation, the pump 101 may include a piston (or plunger) that reciprocates linearly in a liquid chamber and moves in sliding contact with a stationary seal. The piston may be driven (actuated) by any suitable means. In the illustrated implementation, described further below, the piston is pneumatically actuated. The pump 101 may be configured to transport (pump) liquid over a broad range of volumetric flow rates. In some implementations, the pump 101 is configured for low-flow rate operation. Low-flow rates include micro-scale flow rates (e.g., on the order of μL/min) and nano-scale flow rates (e.g., on the order of nL/min). In some implementations, the pump 101 operates at a flow rate ranging from 1 nL/min to 10,000 nL/min.

In the illustrated implementation, the pump 101 includes a housing (or casing, enclosure, body, etc.) 143. The housing 143 may be composed of any material capable of reliably and repeatably withstanding the pressures developed within the pump 101 without failure for an acceptable length of service life, one non-limiting example being steel. The housing 143 is structured, and may include one or more components, as necessary to define a first chamber (or gas chamber) 145, a second chamber (or liquid chamber) 137, and an axial bore 147 interconnecting the first chamber 145 and second chamber 137. In the present context, the term "axial" refers to the orientation or direction of a main or longitudinal axis (or pump axis) of the pump 101, which may be a central axis in a case where the pump 101 is generally symmetrical about this axis. From the perspective of FIG. 1, the axis is vertical by way of example only—no limitation is placed on the orientation of the pump 101 in any given operating environment. The pump 101 also includes a first piston 111 disposed in the first chamber 145. The first piston 111 is linearly movable along the axis between two limits—a bottom-of-stroke (or start-of-stroke) position and a top-of-stroke (or end-of-stroke) position. In the present context, the terms "bottom" and "top" are used merely in a relative sense and not as a limitation on the orientation of the pump 101. The bottom-of-stroke position and top-of-stroke position may be defined by inside surfaces 149 and 151 of the housing 143, respectively. The total axial length along which the first piston 111 is permitted to travel (i.e., from the bottom-of-stroke position to the top-of-stroke position, or vice versa) is referred to as the length-of-stroke, or stroke length L. In the illustrated implementation, the stroke length L is the axial distance between a top surface of the first piston 111 and the inside surface 151.

The first piston 111 is a movable boundary that partitions the first chamber 145 into a pressurized region 135 and a non-pressurized region 153 of variable volume. In the present implementation, the housing 143 may include an axial arrangement of a base 139, a cylinder 109, and a body 113. The base 139 and body 113 are mounted to, adjoined to, or otherwise secured to or integrated with the cylinder 109 at opposite axial ends thereof in a sealed (fluid-tight) manner, which may entail the use of one or more resilient o-rings 105, gaskets or the like at appropriate locations. The pressurized region 135 is defined by one or more inside surfaces of the base 139 and by a bottom surface of the first piston 111. The non-pressurized region 153 is defined by the opposing, top surface of the first piston 111, the inside surface of the cylinder 109, and the surface of the body 113 facing the first piston 111. The non-pressurized region 153 may, for example, contain air or any other suitable gas, and may be at ambient pressure. A first port (or gas port) 107 is formed through a wall of the base 139 whereby the first port 107 provides communication between the pressurized region 135 and any gas-carrying component (not shown) external to the pump 101 that may be placed in communication with the first port 107 such as a pressurized gas supply source or other fluidic component. The outside diameter of the first piston 111 differs from the inside diameter of the cylinder 109 by a small tolerance such that the first piston 111 moves in sliding contact with the cylinder 109 in a sealed manner, which may be facilitated by o-rings located on the outside diameter of the first piston 111. Hence, the first piston 111 maintains fluid isolation between the pressurized region 135 and non-pressurized region 153 while the first piston 111 is moving and at any position of the first piston 111 along the stroke length L. A biasing element 141, such as an appropriate type of spring, is disposed in the non-pressurized region 153 between the first piston 111 and the body 113. The biasing element 141 is positioned and/or configured for imparting a biasing force to the first piston 111 in the direction toward the bottom-of-stroke position.

The pump 101 also includes a second piston (or plunger) 117 disposed in the second chamber 137. The second piston 117 mechanically communicates with the first piston 111 such that the second piston 117 is linearly movable along the pump axis in concert with the first piston 111. Moreover, the stroke length along which the second piston 117 travels through the second chamber 137 is the same as the stroke length L along which the first piston 111 travels through the first chamber 145. In the illustrated implementation, the second piston 117 is an elongated cylindrical structure directly attached to the first piston 111. In such an implementation, the second piston 117 extends through the bore 147 and into the second chamber 137. The bore 147 may include any device or means for fluidly isolating the second chamber 137 from the first chamber 145. In the illustrated implementation, one or more annular seals 115 and 119 (which may be rated for high-pressure operation) are positioned at the interface between the first chamber 145 and bore 147 and/or the interface between the second chamber 137 and bore 147. The second piston 117 moves in sliding contact with the seal(s) 115 and 119. The second piston 117 may be composed of any material capable of withstanding the forces imparted by the seals 115 and 119 on the second piston 117 at the pressures contemplated, such as various metals, metal alloys, and ceramics. As one non-limiting example, the second piston 117 is composed of sapphire. In other implementations, the portion of the second piston 117 illustrated as moving through the bore 147 may be a separate component (e.g., a connecting rod) that interconnects the first piston 111 and second piston 117. In other implementations, the illustrated seals 115 and 119 may be replaced with other means for fluidly isolating the first chamber 145 and second chamber 137, such as packings, stuffing boxes, etc., as appreciated by persons skilled in the art.

In the present implementation, the housing 143 also includes a pump head 123 mounted to, adjoined to, or otherwise secured to or integrated with the body 113 in a sealed (fluid-tight) manner. The second chamber 137 is defined by one or more inside surfaces of the pump head 123. A second port (or liquid inlet port) 121 is formed through a wall of the pump head 123 whereby the second port 121 provides an inlet path for liquid into the second chamber 139 from any liquid-carrying component (not shown) external to the pump 101 that may be placed in communication with the second port 121, such as a liquid supply source or other fluidic component. A third port (or liquid outlet port) 125 is formed through a wall of the pump head 123 whereby the third port 125 provides an outlet path for liquid from the second chamber 137 to any liquid-carrying component (not shown) external to the pump 101 that may be placed in communication with the third port 125, such as a liquid collection site or other fluidic component.

In operation, pressurized gas is utilized to drive the stroke of the first piston 111 and thereby drive the stroke of the second piston 117. The second piston 117 is actuated to reciprocate between an intake (or return) stroke and a discharge stroke. The discharge stroke is effected by charging the pressurized region 135 of the first chamber 145 with pressurized gas via the first port 107. The elevated pressure in the pressurized region 135 pushes the first piston 111 against the biasing force imparted by the biasing element 141. The intake stroke is effected by lowering (relieving) the gas pressure in the pressurized region 135, i.e., by causing gas to flow out from the pressurized region 135 via the first port 107 utilizing an appropriate gas flow control device (not shown). The linear velocity of the first piston 111 (and thus the second piston 117), during either the intake stroke or the discharge stroke, is dictated by the magnitude of the gas pressure in the pressurized region 135 at any given time. The liquid to be pumped may be fed into the second chamber 137 by any means, depending on the application and the system in which the pump 101 operates. For example, liquid may be drawn into the second chamber 137 via the second port 121 by vacuum created by the intake stroke. Liquid is then discharged from the second chamber 137 via the third port 125 during the discharge stroke. The housing 143 (specifically the pump head 123 in the illustrated example) thus defines a liquid flow path through the pump 101 that runs from the second port 121, through the second chamber 137, and to the third port 125. Suitable liquid flow control components (not shown) may be provided in-line with, or otherwise operatively associated with, the second port 121 and third port 125 to facilitate maintaining the proper direction of the liquid flow path. Such liquid flow control components may be passive (e.g., check valves) or active (e.g., actively actuated valves, etc.).

The ratio of the area (i.e., the cross-sectional area in the plane transverse to the pump axis) of the first piston 111 to the area of the second piston 117 corresponds to the pressure gain achieved by the pump 101. For example, assuming the first piston 111 has a diameter of 8.2 cm and hence an area of about 52.8 $cm^2$ and the second piston 117 has a diameter of 0.64 cm and hence an area of about 0.322 $cm^2$, the pressure gain would be about 164, such that a gas pressure of 100 psig applied in the pressurized region 135 of the first chamber 145 would produce a liquid pressure of 16,400 psig in the second chamber 137. Variation in the gas pressure produces a proportional variation in the liquid pressure to the extent that liquid flow out from the pump head 123 is externally restricted. When liquid is allowed to flow out of the pump head 123 and gas pressure is applied in the first chamber 145, the first piston 111 and second piston 117 move vertically (from the perspective of FIG. 1) and in concert as noted above (i.e., the discharge stroke). The flowrate of liquid out of the pump head 123 is proportional to the rate at which the second piston 117 displaces volume within the pump head 123. As liquid flow continues, eventually the first piston 111 moves into mechanical contact with the inside surface 151 of the body 113 and this contact stops further motion of the first piston 111, which state corresponds to the above-noted top-of-stroke or end-of-stroke position. At any point, gas pressure in the first chamber 145 can be relieved, allowing the biasing element 141 to return the first piston 111 into mechanical contact with the inside surface 149 of the base 139 (i.e., the return stroke or intake stroke), which state corresponds to the above-noted bottom-of-stroke or start-of-stroke position, and which is the state specifically depicted in FIG. 1. The return of the first piston 111 to bottom-of-stroke draws liquid through the second port 121, as may be allowed by an attendant check valve or the like (not shown), which action refills the second chamber 137 with such an amount of liquid as might have been displaced during a prior discharge stroke.

In low-flow operations, the movement (velocity) of the second piston 117 may be quite slow, for example ranging from 0.0003 mm/min to 0.3 mm/min. Moreover, some pumping applications may be "one-stroke" operations. That is, the entire volume of liquid to be pumped in a given operation is pumped over the course of a single discharge stroke. After the single discharge stroke, the pump 101 may be "re-stroked" (the intake stroke is again actuated) to replenish the second chamber 137 with liquid in preparation for the next operation. As noted above, the total distance traveled by the pistons 111 and 117 between bottom-of-stroke and top-of-stroke is termed the stroke length L. The product of the stroke length L and the cross-sectional area of the second piston 117 is the maximum volume of liquid dispensed per stroke. For example, in a case where the second piston 117 has a diameter of 0.64 cm and the stroke length L is 2 cm, the maximum volume dispensed per stroke would be about 0.64 mL. This scale of dispensed volume is well-suited for low-flow operations such as, for example, nano-scale and capillary-scale HPLC where flow rates may range from tens of nanoliters per minute to tens of microliters per minute, and hence may entail maximum operational times well in excess of an hour using a single pump stroke.

The application of pressure to the liquid in the pump head 123 produces flow out of the third port 125 through some external flow resistance (not shown) and may also produce leakage flow around the seal(s) 115 and 119, leakage flow backwards through the inlet check valve (not shown) connected to the second port 121, and leakage flow through fittings (not shown) between the second port 121 and its associated check valve. Such leakages are typically on the order of several microliters per minute. The particular leakage rates vary from pump to pump, and for a single pump also vary over the operational lifetime of that pump. As such, it is not possible to use the rate of motion of the pistons 111 and 117 as an accurate measure of flow rate solely out of the third port 125, rather some external flowmeter is typically employed.

To determine leakage rate and other useful information regarding the operation of the pump 101, the pump 101 includes a linear position sensor 155. The linear position sensor 155 is configured for sensing the position of the first piston 111 (or the second position 117) over the entire range of its stroke length L. That is, the linear position sensor 155 is configured not only for sensing whether the first piston 111 has reached a specific position of interest such as the top-of-stroke position, but also for sensing the position of the first piston 111 at any other point along its stroke length L. Thus, the linear position sensor 155 is configured for sensing the presence or absence of the first piston 111 at the bottom-of-stroke position, at the top-of-stroke position, and at any intermediate linear position between the bottom-of-stroke and top-of-stroke positions. For this purpose, the linear position sensor 155 or a component thereof may be in operative communication with (e.g., operatively coupled to) either the first piston 111 or the second piston 117, as the first piston 111 and second piston 117 move in concert. In some implementations, the linear position sensor 155 includes a read element (or read head, indicator, etc.) 133 operatively communicating with a read-out structure (or scale, index, track, etc.) 131. At least one of these two components (read element 133 or read-out structure 131) moves relative to the other component, and the other component may be stationary. Hence, at least one of these two components (the movable component) operatively communicates with the first piston 111 (or second piston 117) in any suitable manner whereby the movable component moves in direct response to movement of the first piston 111. The extent of movement of the movable component may be in any proportion to the extent of movement of the first piston 111. That is, the extent of movement of the movable component may be in a 1:1 ratio with that of the first piston 111, or may be a fractional or integer multiple of that of the first piston 111

The linear position sensor 155 may be realized by a variety of different configurations. In the implementation illustrated by example in FIG. 1, the linear position sensor 155 includes a sensor housing 127 mounted to the pump housing 143 such as at the body 113. The sensor housing 127 encloses the read element 133 and the read-out structure 131. In this example, the linear position sensor 155 is provided in the form of a potentiometer, in which the read-out structure 131 is a strip of electrically resistive material mounted in a fixed position on an inside surface of the sensor housing 127 and the read element 133 is a wiper in electrical contact with the resistive material. The wiper moves (e.g., slides) along the surface of the resistive material in response to movement of the first piston 111. For this purpose, the wiper is attached to a shaft 103 that extends in parallel with the pump axis through the sensor housing 127, a bore of the body 113, and the non-pressurized region 153 of the first chamber 145, and is further attached to the first piston 111. The linear position sensor 155 also includes a biasing element 129 (e.g., a spring) disposed between an inside surface of the sensor housing 127 and the wiper. The biasing element 129 may be positioned and/or configured to bias the wiper into contact with the resistive material, stabilize the movement of the wiper along the resistive material, and/or bias the shaft 103 into contact with the first piston 111.

In the linear position sensor 155 of the present implementation, the linear position of the wiper on the resistive material varies in dependence on the position of the first piston 111 along the stroke length L. In turn, the resistance (or voltage) between the wiper and one (or both) ends of the resistive material varies in dependence on the position of the wiper on the resistive material. In this manner, the linear position sensor 155 may operate as a voltage divider and produce an output signal (voltage or current) proportional to the variable resistance. An appropriate signal processor (not shown) receives the output signal and correlates a value of the output signal with the linear position of the first piston 111. The signal processor may be included as part of the linear position sensor 155 or may be an external component communicating with the linear position sensor 155 via a wired or wireless communication link. For simplicity, other features of the circuitry associated with the linear position sensor 155 that may be provided to fully implement the sensing function are not shown but are readily understood by persons skilled in the art.

More generally, the linear position sensor 155 may have any configuration suitable for encoding the position of the first piston 111 (or second piston 117) over the entire range of its stroke length L, either continuously or on demand, in accordance with the present teachings. Thus, the linear position sensor 155 is not limited to the (electro)mechanical solution just described and illustrated in FIG. 1. The linear position sensor 155 may be in operative communication with (e.g., operatively coupled to) either the first piston 111 or the second piston 117 by any suitable means. Likewise, the linear position sensor 155 may include a read element 133 operatively communicating with a read-out structure 131 by any suitable means, with the read element 133 and/or the read-out structure 131 being movable relative to the other. Various mechanisms for communication or coupling may be suitable, examples of which include, but are not limited to, (electro)mechanical coupling, optical coupling, acoustic coupling, inductive coupling, capacitive coupling, magnetic coupling, and electrostatic coupling. For example, the linear position sensor 155 may be solenoid-based, as in the case of a linear variable differential transformer (LVDT). As a further example, the read element 133 may be a light source and the read-out structure 131 may be an alternating series of opaque and reflective hash marks. Other examples include an acoustic range finder and an optical interferometer.

Figure 2:
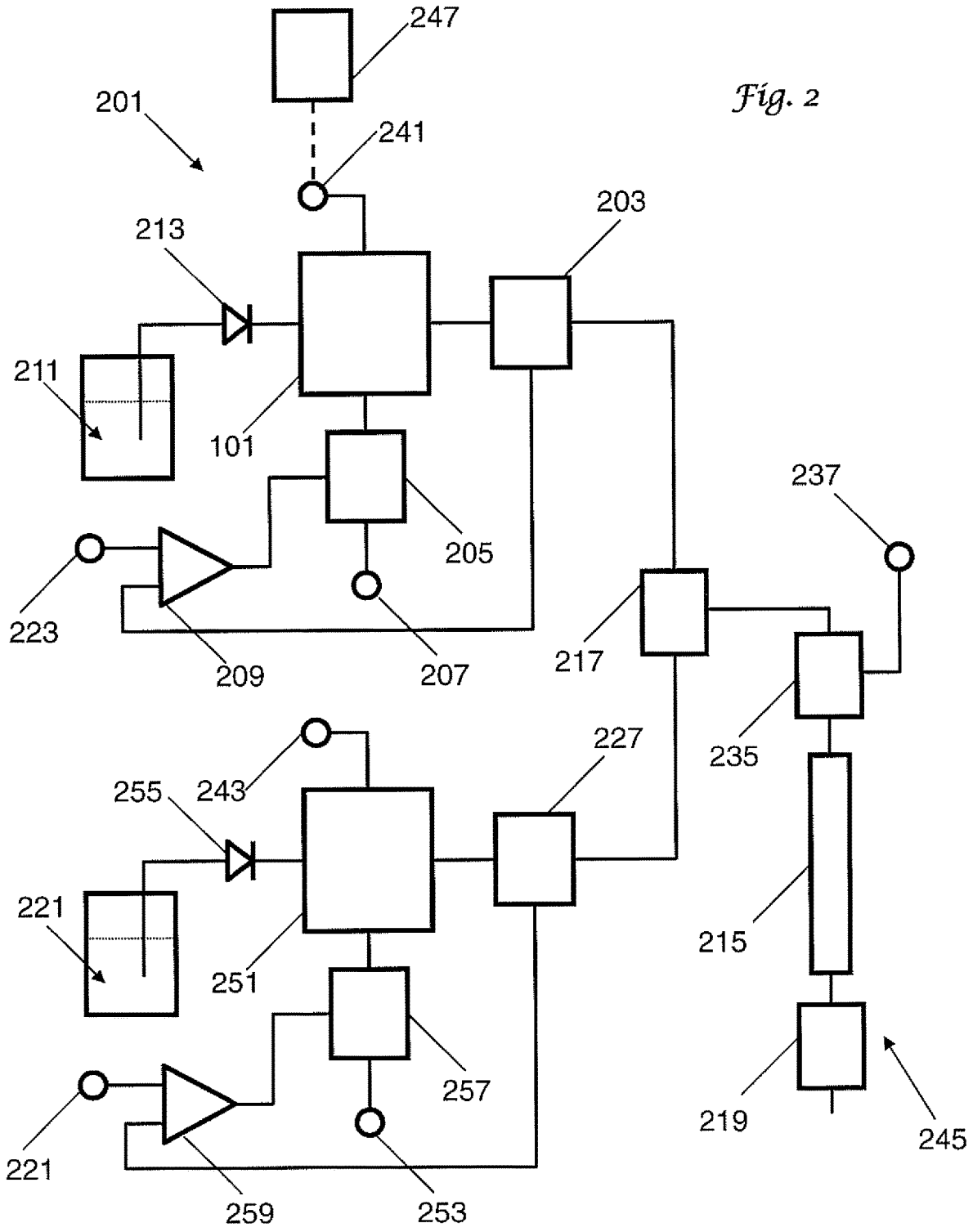
FIG. 2 is a schematic view of an example of a fluid handling system in which one or more pumps such as illustrated in FIG. 1 may operate.

FIG. 2 is a schematic view of an example of a fluid handling system 201 in which one or more linear displacement pumps as disclosed herein may operate. The system 201 may include a pressurized gas source 207 communicating with the first port 107 (FIG. 1) of a (first) pump 101, and a (first) liquid source 211 communicating with the second port 121 (FIG. 1) of the pump 101. The pressurized gas source 207 and liquid source 211 may be any sources suitable for supplying pressurized gas and liquid, respectively, such as containers, reservoirs, etc., and any associated fluidic lines, conduits, and other components. The third port 125 (FIG. 1) of the pump 101 may communicate with any destination site 245 to which liquid from the liquid source 211 is to be transported by the pump 101. The destination site 245 may be any site or structure configured for receiving the pumped liquid, such as one or more containers, reservoirs, collection or waste receptacles, flow dividers, valves, flow control devices, reactors, mixers, detectors, analytical separation devices, devices for introducing the liquid to an analytical instrument, etc. The system 201 may include one or more passive or active flow control devices between the liquid source 211 and the second port 121, such as a check valve 213. The system 201 may also include one or more passive or active flow control devices (not shown) between the third port 125 and the destination site 245.

The system 201 also includes a system controller 247 (e.g., a computing device) that is schematically representative of one or more control modules configured for controlling the operation of the pump 101, or controlling (e.g., switching on/off, adjusting, timing, synchronizing, monitoring, measuring, etc.) the operation of the pump 101 and one or more other components of the system 201. The system controller 247 may include the above-noted signal processor that communicates with the linear position sensor 155 (FIG. 1) of the pump 101 to receive and process output signals produced by the linear position sensor 155. The system controller 247 may also be configured for formatting acquired data as needed to enable the display of user-readable information by an output device (e.g., display screen, analog or digital read-out device, printer, etc.). For any such purposes, the system controller 247 may include hardware and/or firmware modules (e.g., electronic processors, digital signal processors (DSPs), application specific integrated circuits (ASICs), etc.), software modules (e.g., for analyzing data, providing programmed operating parameters, etc.), memory modules (e.g., for storing data acquired by the linear position sensor and/or detectors, for storing software, etc.), and databases as needed for carrying out its control operations, as appreciated by persons skilled in the art. The system controller 247 may include a main processor providing overall control of the pump 101 (or pump 101 and system 201), and one or more other processors configured for dedicated control operations or specific signal processing tasks such as the above-noted signal processor. Moreover, the system controller 247 may include a computer-readable medium that includes instructions for performing all or part of any of the methods disclosed herein.

In the present implementation, the system 201 also includes a gas flow control device 205 communicating with the first port 107 (FIG. 1) of the pump 101 and the pressurized gas source 207. The gas flow control device 205 may be any device suitable for controlling the flow of pressurized gas to the first port 107 (i.e., charging the pump 101) and from the first port 107 (i.e., venting the pump 101). The gas flow control device 205 may be, for example, an electro-pneumatic controller. The gas flow control device 205 may be controlled (or adjusted) by a command signal input 223, which may be received from a user input or from the system controller 247. The system 201 also includes a flow meter 203 communicating with the third port 125 at a downstream location. The flow meter 203 may be any device configured for measuring the volumetric flow rate of liquid flowing from the third port 125. The system controller 247 may include a pump (or pump drive) controller 209 that communicates with the command signal input 223, the flow meter 203 via a signal line, and the gas flow control device 205 via a signal line. By this configuration, the pump controller 209 may compare the flow rate as measured by the flow meter 203 with the command signal received at input 223 and adjust the gas flow control device 205 to alter the gas pressure in the pump 101 via the first port 107 as needed to adjust the liquid flow rate out of the pump 101.

FIG. 2 further illustrates a non-limiting example in which the system 201 is part of or coupled to an analytical instrument such as, for example, an HPLC instrument. In such an implementation, the system 201 may include an analytical separation element 215 and one or more different types of detectors 219. The analytical separation element 215 may be or include, for example, an HPLC column packed with an appropriate porous stationary phase (e.g., octadecyl or $C_{18}$ based) for separating analytes from a liquid sample as appreciated by persons skilled in the art. In this case, the liquid may be an appropriate solvent or blend of solvents serving as the mobile phase that carries the sample through the column. A metered plug of sample from a sample source 237 is merged into the flow of solvent from the pump 101 at (i.e., at, or at a point upstream of) a sample injector 235, which injects the solvent-sample matrix into the column. Analytes of different compositions, separated in time by the stationary phase, elute from the column and flow to one or more detectors 219. For example, the detector 219 may be configured for producing a chromatogram, i.e., a plot of data containing peaks that may be correlated to the differing analytes eluted from the column. As another example, the detector 219 may be another type of analytical instrument to which the column is coupled, such as a mass spectrometer in which case the eluted components from the column are flowed into an ionizing device of the mass spectrometer (e.g., an electrospray ionization (ESI) device, atmospheric-pressure chemical ionization (APcI) device, etc.).

As noted above, the system 201 may include more than one pump. One or more of these pumps may include a linear position sensor 155 (FIG. 1) and other components as described above. In the illustrated example two pumps are shown, a first pump 101 and a second pump 251, although it will be understood that the system 201 may include more than two pumps and associated components. In the illustrated example, the system 201 includes a second pressurized gas source 253 communicating with the first port 107 (FIG. 1) of the second pump 251, and a second liquid source 221 communicating with the second port 121 (FIG. 1) of the second pump 251. The third port 125 (FIG. 1) of the second pump 251 communicates with any destination site 245 to which a second liquid from the second liquid source 221 is to be transported by the second pump 251. The system 201 may include one or more passive or active flow control devices between the second liquid source 221 and the second port 121, such as a check valve 255, and between the third port 125 and the destination site 245 (not shown). The system 201 also includes a second gas flow control device 257 communicating with the first port 107 of the second pump 251 and the second pressurized gas source 253. Alternatively, the system 201 may be configured with plumbing that allows a single or common pressurized gas source to be utilized in conjunction the first gas flow control device 205 and second gas flow control device 257. As a further alternative, a single or common gas flow control device may be configured to separately control respective flows of pressurized gas to and from the first pump 101 and to and from the second pump 251. The second gas flow control device 257 may be controlled (or adjusted) by a second command signal input 221, which may be received from a user input or from the system controller 247. The system 201 also includes a second flow meter 227 communicating with the third port 125 of the second pump 251 at a downstream location. The system controller 247 may include a second pump controller 259 that communicates with the second command signal input 221, the second flow meter 227, and the second gas flow controller 257. The second pump controller 259 may control the flow rate of the second liquid discharged from the second pump 251 in a manner analogous to the first pump controller 209.

The provision of two or more pumps is useful for merging the flows of different liquids under controlled conditions. For this purpose, the respective third ports 125 of the pumps 101 and 251 may communicate with a downstream mixer 217 of any type. In the example specifically illustrated in FIG. 2, the system 201 may serve as a binary gradient HPLC pump (or pumping system). In this case, the first liquid and second liquid may be different solvents that are transported to the mixer 217 at different flow rates, and thus combined in different proportions over time, in accordance with a programmed gradient elution profile executed by the system controller 247. For example, the first command signal input 223 acting on the first pump 101 and the second command signal input 221 acting on the second pump 251 may be arranged to provide a constant total flowrate (i.e., the sum of the flowrates measured by the flowmeters 203 and 227), starting at a combination of some small fraction of the first liquid (e.g., 5 percent) and linearly increasing this fraction over a fixed time period to a high fraction of the first liquid (e.g., 95 percent). One specific yet non-limiting application is reversed-phase gradient chromatography, in which the first liquid is aqueous and the second liquid is organic (e.g., methanol, acetonitrile, etc.).

It will be understood that the system controller 247 may be placed in signal communication with several of the components illustrated in FIG. 2 as necessary to implement the various control tasks described above, such as the first pump 101 at node 241 and the second pump 251 at node 243. Communication may be implemented by any suitable wired or wireless communication links. For simplicity, specific communication links are not shown in FIG. 2.

The output signal produced by the linear position sensor 155 (FIG. 1) may be utilized as a basis for a variety of functions, determinations, calculations, control tasks, or diagnostics. As noted above, the linear position sensor 155 is able to detect any position of the first piston 111 along the stroke length L that is of interest. Thus, the linear position sensor 155 may determine whether the first piston 111 has reached the top-of-stroke position, and also whether the first piston 111 has reached the bottom-of-stroke position. Detecting the top-of-stroke position may be utilized to initiate returning the first piston 111 to the bottom-of-stroke position, for example by venting pressurized gas from the first chamber 145. Detecting the bottom-of-stroke position may be utilized to initiate the next discharge stroke, for example by reflowing pressurized gas into the first chamber 145. Moreover, in conventional pumps that include a top-of-stroke indicator only, a fixed period of time is allowed to effect a re-stroke. That is, upon detection that the end-of-stroke has been reached, the conventional pump is restarted (i.e., the next discharge stroke is initiated) after a period of time is permitted to elapse that is sufficiently long to enable return of the pistons to the start-of-stroke position. This time period is generally set sufficiently large to allow for pump to pump variation. For a particular pump, this time period may be longer than needed for returning to the start-of-stroke position, in which case the extra time adds unneeded delay to restarting the pump. By contrast, the linear position sensor 155 disclosed herein enables the pump 101 (or 251) to be restarted as soon as possible because the linear position sensor 155 immediately detects the return to start-of-stroke position.

Additionally, the linear position sensor 155 may determine whether the first piston 111 has failed to reach the top-of-stroke position, which may indicate that the first piston 111 or second piston 117 is stuck or jammed, the gas flow controller 205 has malfunctioned, a seal has failed somewhere in the pressurized gas circuit (e.g., the first chamber 135, gas source 207, gas flow controller 205, or a gas fitting or conduit), etc. The linear position sensor 155 may also determine whether the first piston 111 has failed to reach the bottom-of-stroke position, which may indicate that the first piston 111 or second piston 117 is stuck or jammed, the gas flow controller 205 has malfunctioned, the biasing element 141 has malfunctioned, etc.

Moreover, the output signal from the linear position sensor 155 may be sampled any number of times during movement of the first piston 111. The signal processor 247 (FIG. 2) may utilize these multiple output signals to determine the rate of change in the value of the signal and correlate the rate of change to the velocity of the first piston 111, and hence the total volumetric dispense rate of liquid from the second chamber 137. Furthermore, the dispense rate may be utilized to determine leakage rates. As one example, during manufacturing, testing or service of the pump 101, the liquid outlet line from the pump 101 may be plugged (e.g., at or downstream from the third port 125) and the volumetric dispense rate may be utilized to measure pump leakage, thereby providing a metric of device qualification. As another example, the outlet of one or more fluidic components downstream of the pump 101 (such as in a system 201 as shown in FIG. 2) may likewise be plugged and the output signal from the linear position sensor 155 applied to measure leak rate in addition to that measured in the pump 101, thereby providing a metric of qualification for such downstream components.

As another example, during normal operation of the pump 101 (and any associated system, such as the system 201 described above and illustrated in FIG. 2 by example), the output signal from the linear position sensor 155 can be monitored selectively on command or continuously to determine the total volumetric dispense rate of liquid in excess of that measured by a flowmeter positioned downstream of the third port 125 (e.g., flowmeter 203 in system 201). This excess in dispense rate may be compared to one or more prescribed values and utilized to indicate the occurrence of a particular event or condition and/or the need for some type of action to be taken. Such indication may be provided in any user-interpretable form such as, for example, a visual or audio alarm, an analog or digital readout, a wired or wirelessly transmitted message, etc. Alternatively or additionally, such indication may be utilized to trigger an automated response or action taken by a component of the pump 101 or its associated system. The excess dispense rate detected may, for example, be compared to some prescribed value that indicates the need for service, or to another prescribed value that indicates a substantial leak and which may further call for an automated shut-down of the pump 101. For instance, an excess leak rate of up to one μL/min may be acceptable whereas an excess leak rate of 2 μL/min may exceed specifications. Additionally, a leak rate of 1.5 μL/min may be chosen to indicate the need for preventative maintenance, an excess leak rate of over 10 μL/min may be chosen to require an automated shutdown of the pump 101, etc.

Figure 3:
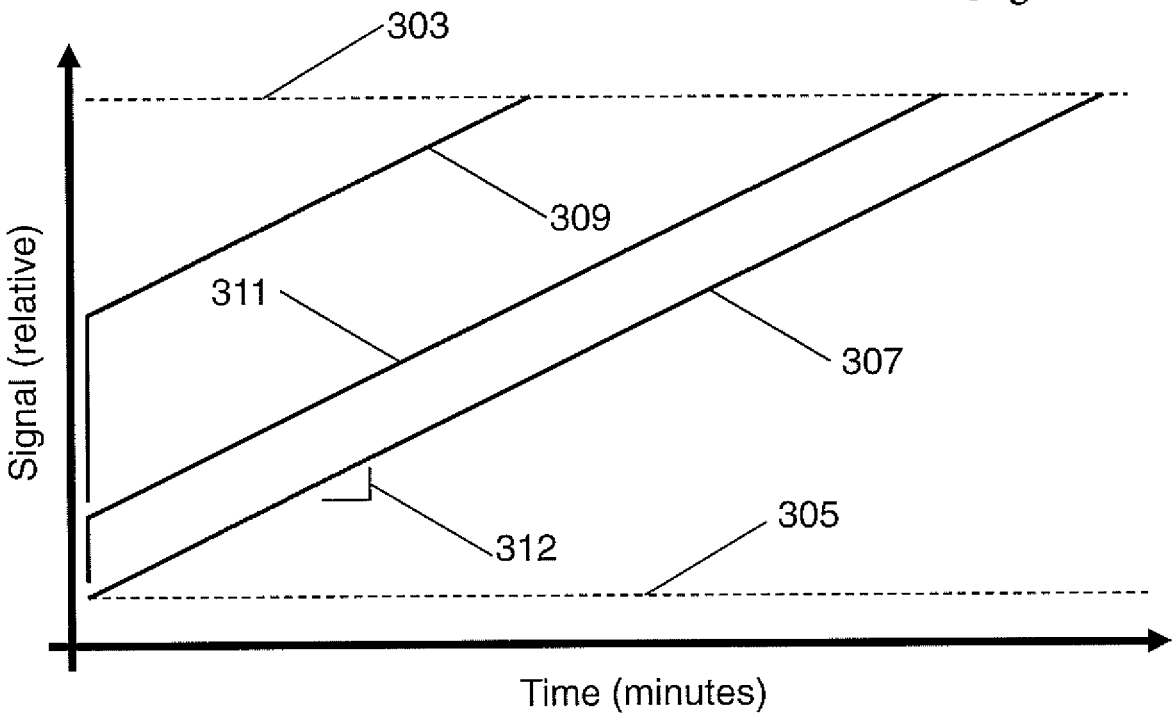
FIG. 3 is a plot of signal (arbitrary units) as a function of time (minutes) for various operating conditions of a pump such as illustrated in FIG. 1.

Additionally, it is often the case that the pump head 123 (specifically, the second chamber 137 thereof, FIG. 1) when at ambient pressure contains some amount of un-dissolved gas (e.g., one or more bubbles). Gases are substantially more compressible than liquids. Thus, when gas pressure is applied to the pump 101 the position of the second piston 117 may jump forward as any gas bubble is compressed. FIG. 3 illustrates a few examples of the effect of gas present in the second chamber 137 during the discharge stroke. During the discharge stroke, the output signal of the linear position sensor 155 varies between a value 305 corresponding to bottom-of-stroke and a value 303 corresponding to top-of-stroke. The start of the traces corresponds to the time when gas pressure is applied to the pump 101 having been in the bottom-of-stroke state. Signal trace 307 varies linearly between stroke limits over the entire stroke length L, thus indicating little or no gas in the second chamber 137. Slope 312 is the velocity of the second piston 117 (and the first piston 111). Signal trace 311 shows the occurrence of an initial jump in piston position of about one-quarter of the total range (stroke length L), indicating that about one-quarter of the volume of the second chamber 137 contained gas at the start of the discharge stroke. Signal trace 309 shows the occurrence of an initial jump in piston position of over one-half of the total range, indicating that over one-half of the volume of the second chamber 137 contained gas at the start of the discharge stroke.

In positive linear displacement pumps such as described herein, it is desirable for the pump head 123 to be filled with liquid during operation. The pump head 123 may be "purged" to displace any residual gas and assure that the pump head 123 is filled with liquid. Such purging may be done at pump installation, during a change of liquids, and as part of regular maintenance. The character of the rate-change in the output signal of the linear position sensor 155, as measured at first application of pressure to the pump 101, may be utilized to determine the presence and nominal volume of a gas bubble within the pump head 123. The information acquired by the linear position sensor 155, such as that shown in FIG. 3, may be utilized to indicate that the pump 101 needs to be purged. This information can be further applied to determine whether sufficient purging has been achieved, and may be utilized by the user or by an automated purge system.

Figure 4:
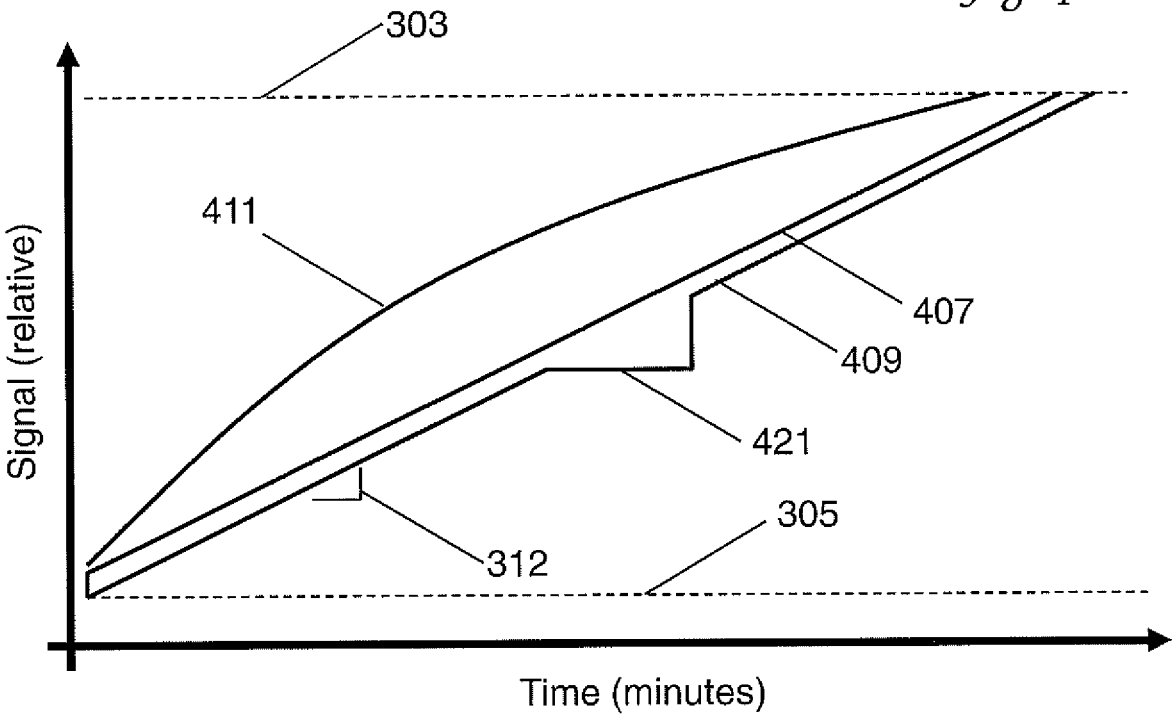
FIG. 4 is another plot of signal (arbitrary units) as a function of time (minutes) for various operating conditions of a pump such as illustrated in FIG. 1.

FIG. 4 shows several other possible traces of piston position over time. Trace 407 indicates a slight gas bubble present at starting, followed by a relatively constant slope 312 and hence constant velocity through to end-of-stroke. Trace 409 shows a similar slope except for a period 421. At the beginning of period 421, the slope substantially decreases indicating a substantial decrease in velocity, which is followed by a sudden increase in slope and finally a return to the initial slope 312. Trace 409 can be interpreted as indicating that the first piston 111 or second piston 117 became stuck during period 421, and eventually broke free and jumped forward, and finally recovered the initial velocity. Trace 411 shows substantial curvature that indicates a time-varying velocity and hence a variation in the net force driving the piston 111 or 117. This result may indicate, for example, a dragging biasing element 141, a gas leak from the base 139, an obstruction in the first port 107, or a faulty gas flow controller 205. From these examples it will be evident that other trace profiles are possible, and their interpretation may yield other types of useful information. More generally, the shape of the sensor trace—linear versus curved, abrupt change in slope, failure to reach top-of-stroke or bottom-of-stroke conditions, etc.—may be utilized to determine the proper operation of the pump 101 during manufacture, qualification and during user operation. The shape of the sensor trace during re-stroke or intake stroke (i.e., from top-of-stroke to bottom-of-stroke) may also be utilized as a diagnostic in the same or similar manner as during the discharge stroke.

As noted above, certain liquid transport applications (including, for example, chromatographic runs) may be "one stroke per run" operations, in which all of the liquid utilized in the operation is pumped during a single stroke. Moreover, in certain liquid transport applications (including, for example, one stroke per run operations), the flow rate of liquid discharged from the pump 101 may be quite low. In these applications, the duration of a single operational run may range from a fraction of a minute to several hours, and flow rates may range from one or more hundreds of nanoliters per minute (e.g., reverse phase separation of peptides with a 15 cm long and 75 μm diameter column followed by mass spectrometer detection for proteomic analysis) to one or more hundreds of microliters per minute (e.g., reverse phase separation of metabolites with a 5 cm long and 1 mm diameter column followed by mass spectrometer detection for clinical studies). One stroke per run operations may also be implemented at higher flow rates, such as are commonly utilized with even larger diameter columns. In low flow rate and one stroke per run operations, the output signal from the linear position sensor 155 may be utilized to indicate to a user or system controller 247 that a particular method is using nearly all the liquid within one or more pumps, and as such to further indicate that the method should be modified (e.g., run times shortened, flow rates reduced, etc.) as appropriate to make the method more robust towards inevitable variation in leak rates. As an example, assume that the total dispensable volume in the pump head 123 is 0.6 mL and that the user has specified a series of two-hour runs with a process flow rate of 2000 nL/min. Assume further that in executing the runs the linear position sensor 155 detects a total dispense rate of 4500 nL/min, thus indicating a leakage rate of 2500 nL/min (the excess of the process flow rate). The time to re-stroke is then about 133 minutes, and so the user has a 13 minute margin. In one instance the pump 101 (or system 201) may alert the user that the margin is slim, allowing the user to take corrective action or alter the run specifications. In another instance the pump 101 (or system 201) may alert the user should the user request a 2.2 hour run, in which case there is no margin.

The sensor signal may also be utilized to indicate to the user or system controller 247 that there is sufficient liquid within the pump(s) to proceed not only to complete the current task but also to complete the next scheduled task without first performing a re-stroke. In such a situation, deferring the re-stroke saves time that is of particular value in applications requiring rapid cycle times to achieve high sample throughput.

It will be understood that in low-flow implementations, one or more of the fluidic components described above and illustrated in FIG. 2 may be microfluidic components. Microfluidic components may reside on or in, or form a part of, one or more microfluidic chips, substrates or other micro-scale structures (e.g., labs-on-a-chip, micro-total analysis systems (μTAS), micro-electromechanical systems (MEMS), etc.). One or more of the fluid lines (or conduits) described above and illustrated in FIG. 2 may thus be microfluidic conduits.

As used herein, the term "microfluidic conduit" generally refers to a conduit (tube, capillary, channels channel, etc.) having an inside diameter no greater than about 2 mm. In practice, the inside diameter of a microfluidic conduit may range from about 0.01 mm to about 2 mm. Microfluidic conduits are commercially available in different inside diameters such as, for example, 0.025 mm, 0.05 mm, 0.15 mm, 0.2 mm, 0.3 mm, etc. More generally, a microfluidic conduit is sized for effectively transferring a fluid at nano-scale flow rates (nL/min) and/or micro-scale flow rates (typically up to hundreds of μL/min). In applications entailing analytical separation, the microfluidic conduit should be sized to minimize the dispersion of sample peak data. Generally, no limitation is placed on the length of a microfluidic conduit, so long as the length is sufficient for its intended purpose in a given application. A microfluidic conduit of significant length may be initially provided and thereafter cut to a desired shorter length as needed. Generally, no limitation is placed on the outside diameter of a microfluidic conduit, so long as the outside diameter results in a wall thickness providing the level of structural robustness required for withstanding the fluid pressures contemplated in a given application. In some applications such as micro-scale (micro-column) HPLC, the fluid pressure may be on the order of tens of thousands of psi. For applications having a particular need for compactness, the outside diameter should not be excessively large or beyond what is needed for the fluid pressures contemplated. In some embodiments, the outside diameter of the microfluidic conduits may range from about 0.125 mm to about 2 mm. Microfluidic conduits are commercially available in different outside diameters such as, for example, 0.15 mm, 0.36 mm, 1/32 inch (about 0.8 mm), 1/16 inch (about 1.6 mm), etc.

For convenience, the term "diameter" (including "inside diameter" and "outside diameter") as used herein generally refers to the characteristic dimension (or size) of any cross-sectional area of a component such as a conduit, tube, capillary, sleeve, jacket, layer, coating, or the like. In typical embodiments, such components are cylindrical with circular cross-sections, such that the term "diameter" is accurately descriptive of the characteristic dimension of such components. It will be understood, however, that such components may alternatively have elliptical or polygonal cross-sections. The characteristic dimension of an elliptical cross-section may be considered as being a major axis. The characteristic dimension of a polygonal cross-section may be considered as being a dominant length or width of a side, or the distance between two opposing corners. The term "diameter" as used herein encompasses all such types of characteristic dimension, regardless of the actual shape of the cross-section, and thus is not intended to limit any given component to having a circular cross-section.

It will be understood that the controller 247 schematically illustrated in FIG. 2 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software for display by an output device, and one or more devices for loading media readable by the controller 247 (e.g., logic instructions embodied in software, data, and the like). The controller 247 may include an operating system (e.g., Microsoft Windows® software) for controlling and managing various functions of the controller 247. One or more components of the controller 247 may be located remotely from the pump 101 or system 201 and communicate with the local portion of the controller 247 over a wired or wireless communication link.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the controller 247 schematically depicted in FIG. 2. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the controller 247 in FIG. 2), direct the electronic system to carry out the instructions. The computer program product may be selectively embodied in any non-transitory computer-readable storage medium for use by or in connection with an instruction execution system, apparatus, or device, such as a electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program can be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for pumping a liquid in a linear displacement pump, the method comprising:

discharging liquid from the pump, the pump comprising a first chamber a second chamber, and a piston assembly comprising a first piston and a second piston moveable in a direction, the first piston linearly movable through the first chamber along a stroke length from a bottom-of-stroke position to a top-of-stroke position, and the second piston linearly movable through the second chamber, the second piston mechanically communicating with the first piston and movable with the first piston, wherein the discharging comprises driving the first piston along at least part of the stroke length such that the second piston discharges the liquid from the second chamber;

while discharging the liquid, sensing, through a sensor, a linear position of the first piston at a plurality of positions along the stroke length, wherein at least a component associated with the sensor passes through a part of a housing of the pump, the component communicates with at least one of the first piston or the second piston;

by movement of the component, detecting changes from normal operation of the pump in a velocity of the first piston or the second piston during piston movement between the top-of-stroke position and the bottom-of-stroke position;

producing a plurality of output signals respectively corresponding to the plurality of positions sensed; and based on one or more of the output signals produced, identifying a cause of at least one particular abnormal state from a plurality of abnormal operational states of the pump based on a slope or curvature of the detected changes in the velocity of the component from normal operation of the pump during the piston movement between the top-of-stroke position and the bottom-of-stroke position.

2. The method of claim 1, wherein discharging liquid comprises pneumatically actuating the first piston.

3. The method of claim 1, wherein sensing comprises operating a linear position sensor communicating with the first piston by a coupling selected from the group consisting of a mechanical coupling, an optical coupling, an acoustic coupling, an inductive coupling, a capacitive coupling, a magnetic coupling, and an electrostatic coupling.

4. The method of claim 1, wherein driving the first piston comprises changing a position of a read element of the pump relative to a read-out structure of the pump or changing a position of the read-out structure relative to the read element, and wherein the position of the read element relative to the read-out structure is proportional to the linear position of the first piston, and at least one of the read element and the read-out structure is movable with the first piston.

5. The method of claim 1, wherein determining the operational state comprises determining that the first piston has reached or failed to reach the top-of-stroke position, or that the first piston has reached or failed to reach the bottom-of-stroke position.

6. The method of claim 1, wherein determining the operational state comprises determining that the first piston has reached the top-of-stroke position or the bottom-of-stroke position, and further comprising, based on the determination, moving the first piston toward the bottom-of-stroke position or moving the first piston toward the top-of-stroke position respectively.

7. The method of claim 1, wherein determining the operational state comprises measuring the velocity of the first piston and wherein based on the velocity measured, determining a volumetric flow rate at which liquid is discharged from the pump, or determining whether the velocity is varying in time during movement of the first piston along the stroke length, or determining whether the velocity measured differs from a set-point velocity, or determining a volume of liquid remaining in the pump.

8. The method of claim 1, wherein determining the operational state comprises measuring a first volumetric flow rate of liquid discharged from the pump at a location downstream from the pump, measuring a second volumetric flow rate of liquid discharged from the pump based on the output signals produced, and determining whether the first volumetric flow rate and the second volumetric flow rate differ.

9. The method of claim 8, comprising comparing a difference between the first volumetric flow rate and the second volumetric flow rate to one or more stored values and, based on the comparison, performing an operation selected from the group consisting of: adjusting the velocity of the first piston; providing a user alert; shutting down the pump; and a combination of two or more of the foregoing.

10. The method of claim 1, wherein determining the operational state comprises measuring the velocity of the first piston during movement thereof along the stroke length, and determining whether the velocity measured is varying in time at one or more points along the stroke length for determining whether gas is present in the second chamber or whether movement of the first piston or the second piston has been impaired.

11. The method of claim 1, wherein determining the operational state comprises plugging a liquid outlet of the pump, measuring the velocity of the first piston and, based on the velocity measured, determining a leakage rate of liquid in the pump.

12. The method of claim 1, wherein determining the operational state comprises measuring the velocity of the first piston and, based on the velocity measured, determining a volume of liquid remaining in the pump and, based on the volume of liquid remaining in the pump, determining whether to move the first piston toward the bottom-of-stroke position.

13. The method of claim 1, wherein identifying the particular abnormal state comprises identifying at least one of a) un-dissolved gas in the liquid being pumped, b) the second chamber containing gas at the start of the discharge stroke, c) a gas bubble present at starting of the piston movement, d) one of the first piston or the second piston being stuck and breaking free, and e) a variation in a net force driving the piston movement.

* * * * *